United States Patent [19]

Tatch

[11] 4,161,722

[45] Jul. 17, 1979

[54] SIGNAL DECODING SYSTEM

[75] Inventor: Martin S. Tatch, San Diego, Calif.

[73] Assignee: The United States of America as represented by the Secretary of the Navy, Washington, D.C.

[21] Appl. No.: 687,963

[22] Filed: Nov. 30, 1967

[51] Int. Cl.[2] ..... H04B 7/00

[52] U.S. Cl. ..... 340/171 R; 343/225; 343/228

[58] Field of Search ..... 340/171, 171 R, 171 A; 343/6.5, 6.5 SS, 225, 228

[56] References Cited

U.S. PATENT DOCUMENTS

| | | | |
|---|---|---|---|
| 3,395,390 | 7/1968 | Parker et al. | 340/171 R |
| 3,495,219 | 2/1970 | Clapp et al. | 340/171 R |
| 3,551,889 | 12/1970 | Miller | 340/171 R |
| 3,699,522 | 10/1972 | Haner, Jr. | 340/171 R |

*Primary Examiner*—Howard A. Birmiel

*Attorney, Agent, or Firm*—R. S. Sciascia; W. Thom Skeer

[57] ABSTRACT

A decoding logic receiver is used to actuate a device by remote control when and only when the proper coded signal is received.

3 Claims, 9 Drawing Figures

| CIRCUIT | LOGIC BLOCK SYMBOL | NAME | DEFINITION |
|---|---|---|---|
|  |  | NAND | OUTPUT IS LOW (GND) IF ALL INPUTS ARE HIGH (>5V). |
|  |  | NOR | OUTPUT IS HIGH (≈10V) IF A OR B OR C ARE HIGH (>5V). |
|  |  | DELAY MULTI-VIBRATOR | FIXED DELAY IS GENERATED FOR EACH NEGATIVE INPUT PULSE. |
|  |  | RS FLIP-FLOP | NEGATIVE INPUT AT S GIVES HIGH (≈10V) OUTPUT AT T, LOW AT F. NEGATIVE PULSE AT R GIVES CONVERSE. |

SIGNAL DECODING SYSTEM

BACKGROUND OF THE INVENTION

Decoding devices are known which are designed to initiate the operation of electromechanical equipment, sound a warning, or perform any similar function capable of electrical initiation, upon receipt of the proper coded signal.

A multifrequency signaling receiver for such purposes is shown, for example, in U.S. Pat. No. 3,281,790, issued 25 Oct. 1966 to L. C. J. Roscoe et al., and a transistorized device for similar purposes is the subject of U.S. Pat. No. 3,287,701, issued 22 Nov. 1966.

Prior systems have, in some instances, been susceptible to operation by random signalling, active jamming, etc., and none are known which have been designed to prevent unauthorized operation even by persons possessing knowledge of the mode of operation.

The device according to the present invention is constructed to not only be incapable of operation by random signalling but also to make operation of the system by unauthorized persons so extremely improbable as to be practically impossible even though such persons possess knowledge of the frequencies involved and the mode of operation of the device.

The Decoding Logic System according to the invention was developed as the result of a need for a small, light unit which could be left in remote locations to initiate operation of various devices at a later time by remote control. Reliability of operation was considered important but equally important was the need to prevent unauthorized persons from prematurely actuating the devices.

The device of the present invention achieves its purpose with only relatively small power and space requirements and may be inexpensively manufactured in quantity.

DETAILED DESCRIPTION OF THE INVENTION

System Requirements

The function of the Decoding Logic System of the present invention is to provide remote actuation of devices while acting to prevent an active jamming or a random search signal from unlocking the actuation code and causing a premature operation of the devices.

The primary characteristics of the system, rated in descending order of importance, are as follows:

1. Utilization of a multiple tone coding scheme with a six second minimum release time.
2. Minimum false recognition rate in keeping with a reasonable probability of success for recognition of a correct code reception in a minimum number of trails.
3. Low input with high reliability using a set of standard logic "blocks" utilizing a minimum number of components.
4. Size, weight, and cost factors optimized; battery requirements being probably the most significant factor in determining overall size and weight.

Logic Derivation

Figure 1:
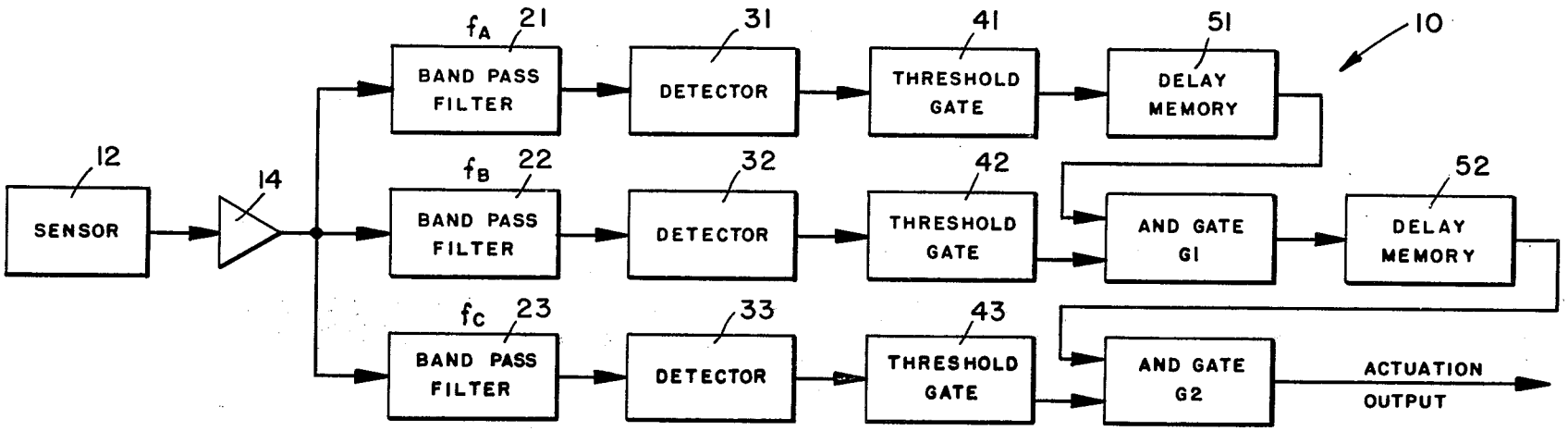
FIG. 1 is a simplified block diagram of a decoding system according to the invention.

Based upon the above criteria, a basic decoding system of the type shown in FIG. 1 has been developed. The authentication requirements for a preferred embodiment of the system are listed as follows:

1. The correct actuation code will be a sequential transmission of three (3) discrete tones occurring in the following order—Tone A—pause—Tone B—pause—Tone C. A specific length of time will be assigned to each tone transmission and to each separation interval in order to obtain maximum flexibility of the code.
2. The recognition of a correct code sequence will result in an actuation pulse input to the operating train.
3. The recognition of any form of incorrect code, e.g., wrong order, simultaneous tones, tones missing, etc., will result in an immediate inhibit or lock-out function which will disable the actuating circuit for a specific length of time. The various combinations of correct and incorrect codes that the logic system must respond to are shown below in logical notation.

$$F=A\overline{BC},\ \overline{A}B\overline{C},\ \overline{AB}C.$$

$$I=\overline{A}+B+C,\ A+\overline{B}+C,\ A+B+\overline{C}.$$

where

F=actuation command

I=inhibit function

+=or

Figure 8:
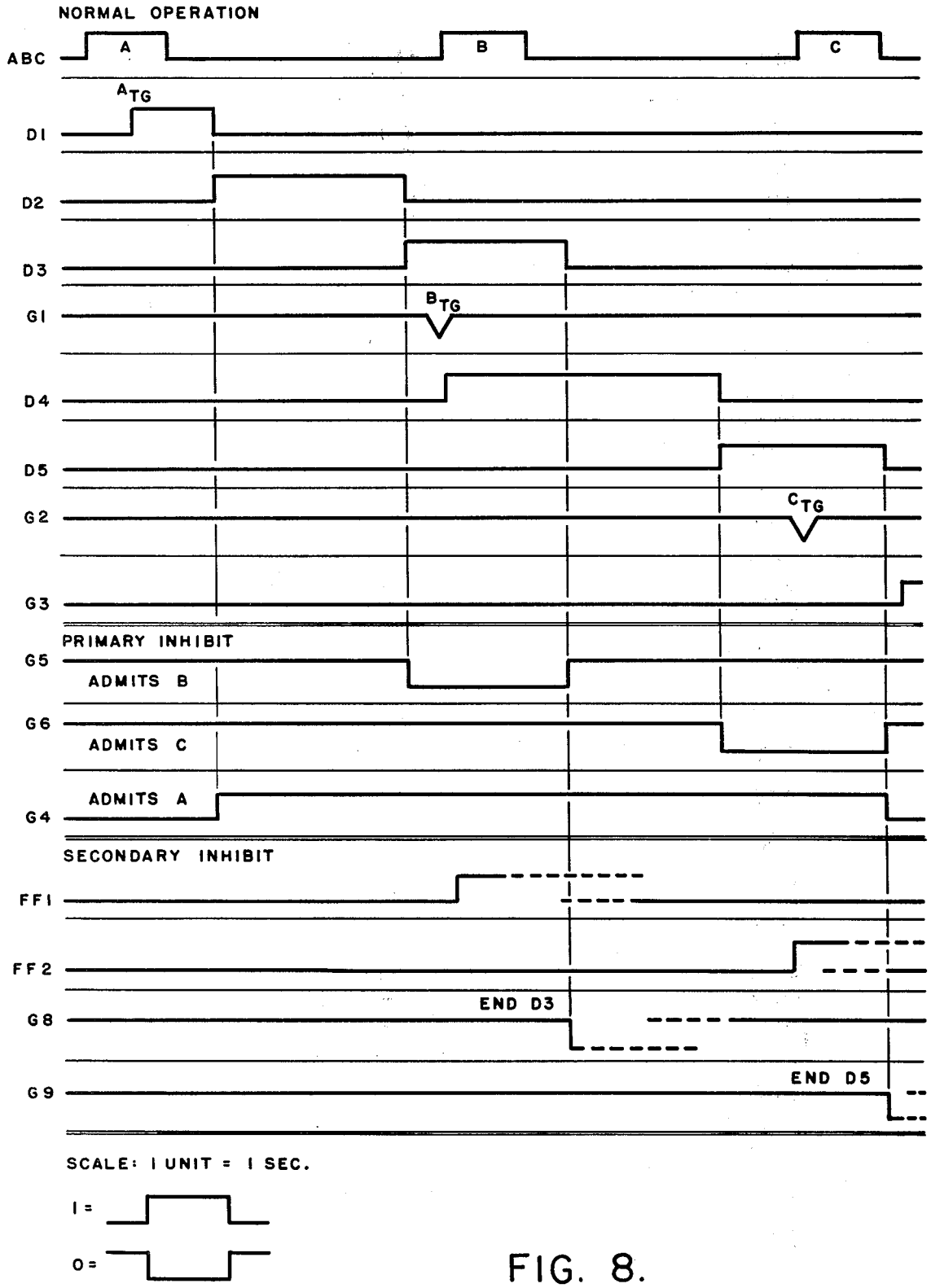
FIG. 8 is a Waveform Diagram showing the timing of the system.

For the purpose of demonstrating the logic system, the correct actuation code has been defined as three seconds of continuous tone transmission with ten second spacing between tones A and B and between tones B and C (see FIG. 8). Although the addition of finite spaces between tones is not an absolute necessity, the inclusion of the spaces avoids the possibility of errors involving overlap of successive signals which may occur because of the asynchronous nature of the system.

System Block Diagram

FIG. 1 shows an overall block diagram of the decoding system. The system 10 comprises three threshold gates 41, 42, 43, two delay memories 51, 52, and two AND gates G1, G2. The logical decoder contains three main groups of elements, e.g., actuation Sequence, Primary Inhibit Sequence, and Secondary Inhibit Sequence. The signal coming to the decoder and received by the sensor 12 passes through amplifier 14 and selective filters 21,22,23 and the respective filter outputs are then demodulated by respective Detectors 31, 32, 33 and applied respectively to threshold gates 41, 42, 43.

Figure 3:
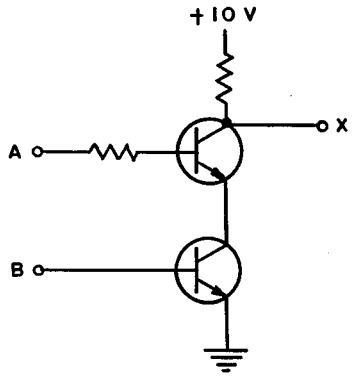
FIG. 3 is a chart of typical logic circuits used in the invention.
Figure 3:
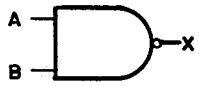
Figure 3:
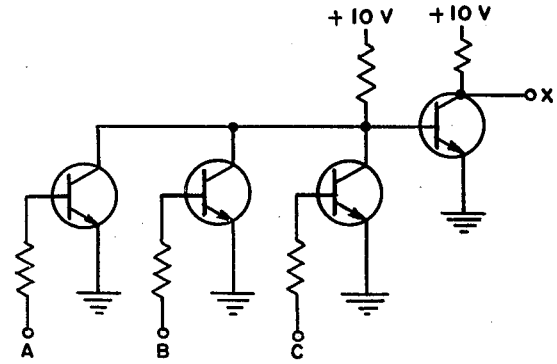
Figure 3:
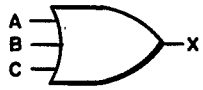
Figure 3:
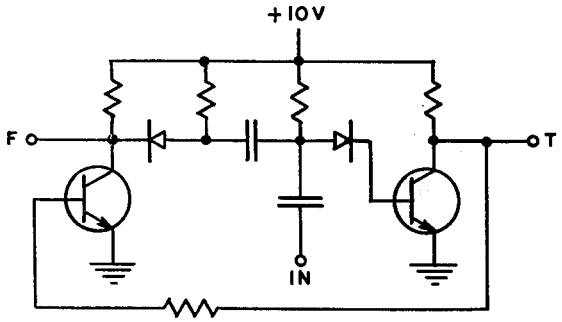
Figure 3:
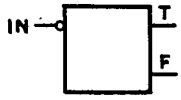
Figure 3:
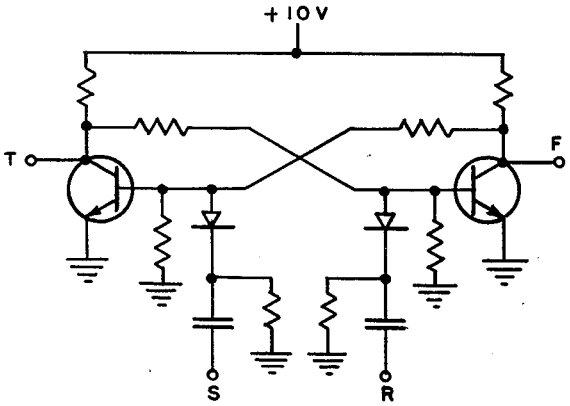
Figure 3:
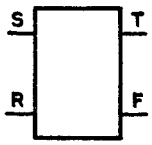

As shown in FIG. 3, conventional logical building block circuits such as gates, flip-flops, and delay multivibrators are here utilized in order to maintain a completely general approach. It will be apparent, however, that other comparable components could be used in the exercise of the invention.

Actuation Sequence

Figure 4:
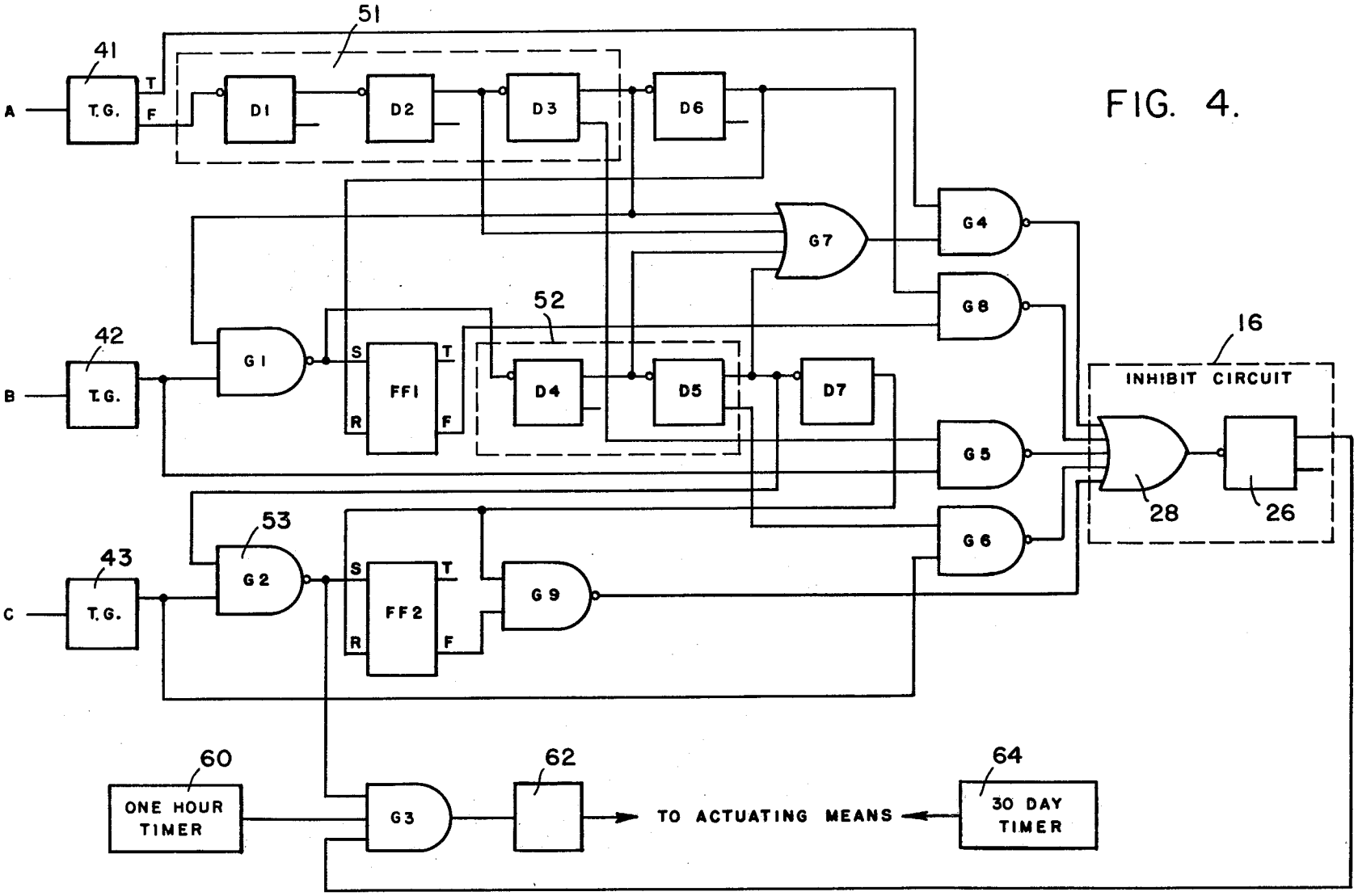
FIG. 4 is a logic block diagram of a decoder according to the invention.

The basic actuation sequence decoder circuits are shown in FIG. 4. The operation of the system is as follows. At some time during the three seconds that Tone A is being received, the A threshold gate 41 will be tripped, see lines 1 and 2 of FIG. 8. This will cause the first delay gate D1 to generate a three second delay which begins at the same time that the threshold gate 41 is tripped. Following the three second delay, D2 generates a seven second delay and then D3 generates a six second pulse. An AND gate G1 is enabled throughout the period of D3, and at some point in this period the B threshold gate 42 will trip, this in turn starting delay D4 for a timing period of ten seconds.

Note that G1 is enabled throughout the entire span of time that the B threshold circuit can be tripped. This is necessary since the time it takes a given tone to cross the threshold is variable. Because of the action of the limiting circuits in the receiver, the time required for the detector to reach the threshold is a function of wave path conditions, signal power, signal-to-noise ratio, and other conditions which in general preclude the possibility of reaching the threshold coincidentally with the initiation of the tone transmission, as would be the case for an ideal noiseless wire transmission system. Another way of stating this is that the logic system cannot recognize the exact instant at which the tone transmission is initiated.

Continuing with the actuation sequence, at the end of the ten-second period of D4, delay D5 enables gate G2 for six seconds. During this time the C threshold 43 will trip which immediately causes gate G2 to trip Gate G3, thus initiating the actuation impulse.

Primary Inhibit Sequence

Figures 5, 5A, 6:
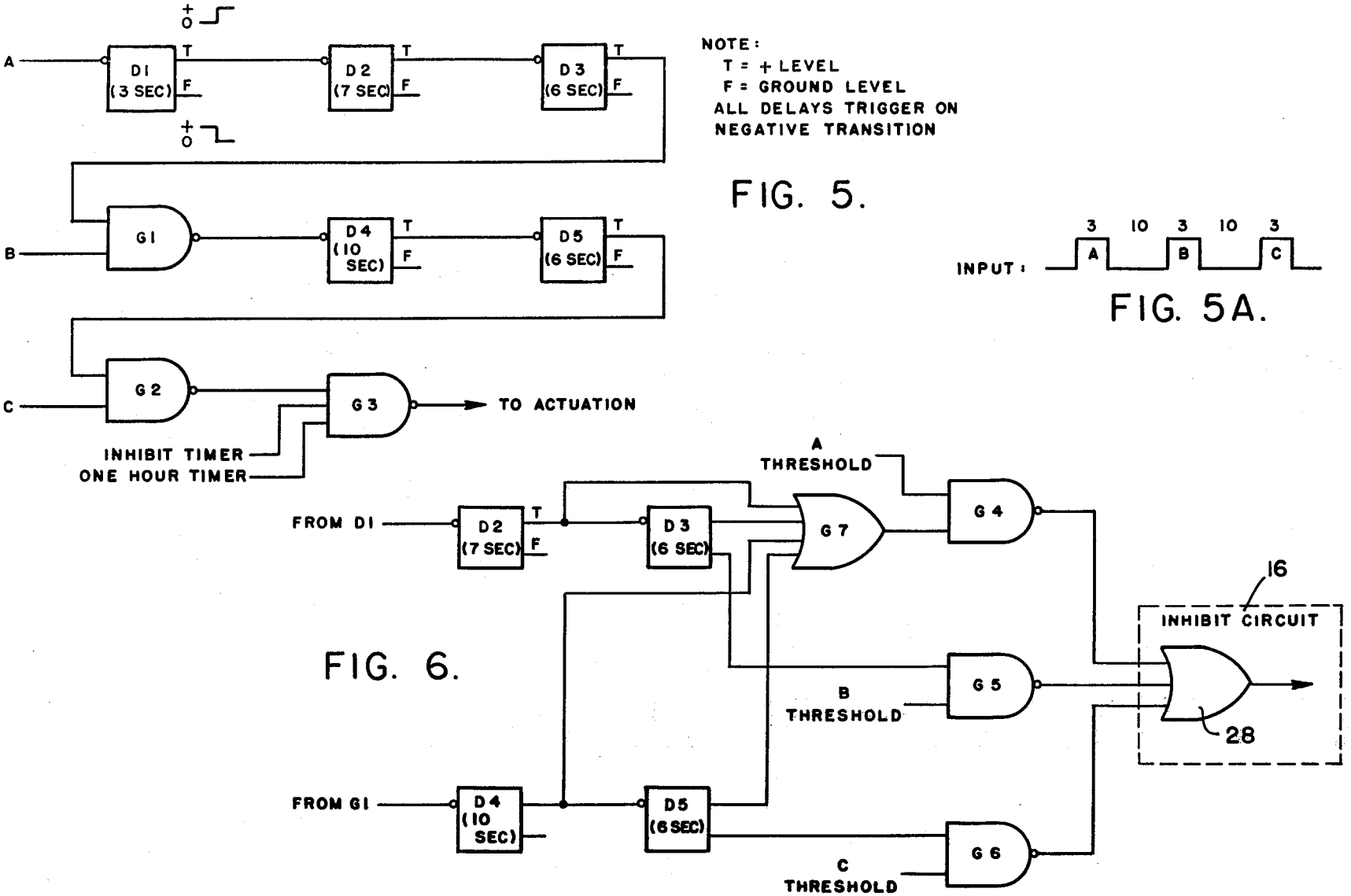
FIG. 5 is a logic block diagram for operation initiation.
FIG. 5A is a graphic representation of a correct input signal.
FIG. 6 is a Primary Inhibit Logic Block Diagram.

The purpose of the primary inhibit level of logic is to recognize a transmission which consists of either two or more simultaneous tones or a wrong sequence of tones. In either case, the inhibit circuit reacts immediately upon receipt of the first "wrong" tone to lock-up the Decoder through inhibit timer 26 for a preset period of time. This time may be set anywhere from several seconds to as much as fifteen minutes depending upon operational requirements. FIG. 6 shows the primary logic in block diagram form. The system operates as follows:

Gates G5 and G6 are always enabled by the false outputs of D3 and D5 respectively, except during the six seconds periods when D3 or D5 are conducting (see FIG. 8). D3 conducts during the only allowable time span for reception of a B tone, and D5 conducts during the only time span for the reception of a C tone. Three seconds after reception of an A tone, gate G4 is enabled during the conducting periods of D2, D3, D4, and D5 by G7, a logical OR gate. Thus it is evident that the signal path to the inhibit circuit 16 is open through either G4, G5, or G6 except for the exact period of time when tones A, B, or C should be received. Therefore, if any tone is received in a "wrong" time slot, it will immediately cause the inhibit circuit 16 to react and lock-up the actuation circuit 62.

Secondary Inhibit Sequence

Figure 7:
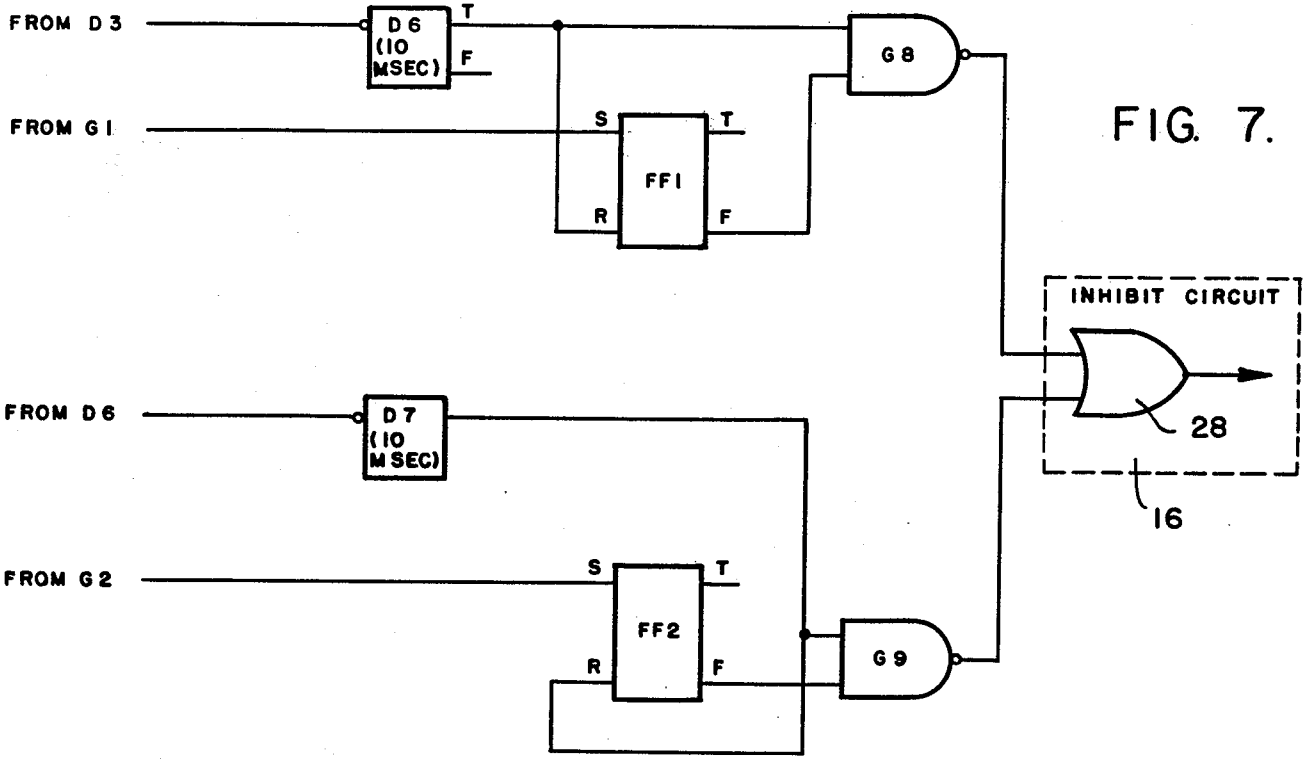
FIG. 7 is a Secondary Inhibit Block Diagram.

The purpose of the secondary inhibit logic level is to recognize the absence of a tone from its correct time position. The output of the system is also an inhibit function which locks-up the actuation circuit. The block diagram is shown in FIG. 7. The operation of the system is as follows:

G8 will still be enabled when the end transistion of D3 turns D6 on. Then D6 will turn on the inhibit circuit. G9 and FF2 function in a similar manner to recognize a missing tone C. D6 and D7 also are used to turn FF1 and FF2 off again. This is necessary to allow detection of an error in the next complete sequence. The period of D6 and D7 is not critical. They must be on only long enough to turn off FF1 and FF2 or turn on the inhibit circuit.

Circuit Implementation

Since the entire logic system is designed with standard circuits which are readily available in a wide variety of packages, units may be manufactured in quantity at low cost. A low power drain on the battery is of prime importance when a small remote system must remain in operation for a period of thirty days or more. The logic system consists of three threshold gates, seven delay circuits, two flip-flops, and eight gates. Based upon an average figure of 2 to mw (at $V_{cc}=3v$) per circuit for the lowest power integrated circuits available today, the logic system battery power for thirty days operation amounts to 37.5 wat hours at 3 volts. However, by the use of discrete components in specially designed low power circuits, it has been demonstrated in breadboard models that the battery power required for the logic system may be reduced to about 1.125 watt hours at 10 volts. In addition to the significant reduction in required power, the higher operating voltage of the circuits is compatible with the supply voltage for the linear circuits which comprise the receiver section of the unit. Thus, the need for separate batteries for the receiver and decoder sections is eliminated.

All of the logic circuits used in the laboratory model were based on a standard design utilizing a high gain, low leakage silicon transistor, the General Electric 2N3391A. This unit is packaged in an industrial type cast epoxy mounting and has a wide temperature range of operation and high stability due to the use of a planar passivated construction technique. The storage temperature range is from −55 to +125° C., which is effectively the upper operating limit for this type of digital circuitry. In addition, the extremely low cost of this unit, typically less than fifty cents each in quantities greater than one thousand, makes it an excellent choice from the economic standpoint.

FIG. 3 shows some of the typical circuit designs used in the logic system. Although the circuits have not been tested over an extreme temperature range there is no reason to expect any difficulty over the range of temperatures normally expected to be encountered in the environment in which the units may be placed. Note that the maximum current drawn by a circuit is on the order of ten microamperes. Operation at such a low value of collector current results in very slow transition times (1–5 msec) for the logic circuits, however, high speed is not of prime importance in this system.

AUTHENTICATION CAPABILITY

Figure 2:
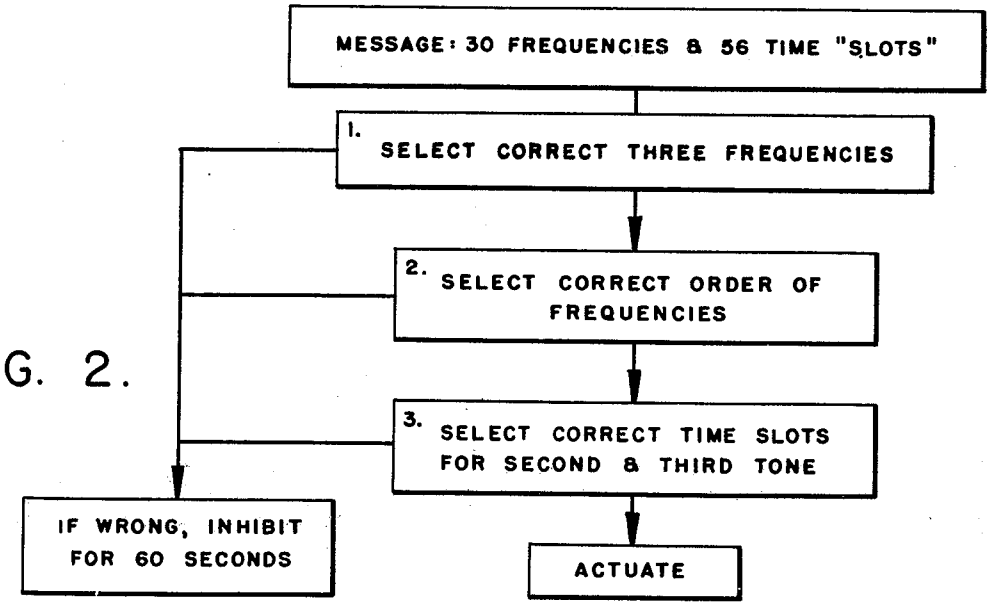
FIG. 2 is a graphic representation of steps necessary for an unauthorized transmitter to initiate operation.

The authentication capability of the logic decoding can be evaluated by assuming a typical situation and computing the time required to transmit a correct message. Refer to FIG. 2. In order to evaluate a realistic situation, we shall assume an unauthorized transmission source has access to certain pertinent data concerning the parameters of the actuation code; this in effect will give a "worst-case" analysis.

The rules for the message format are as follows:

1. Three different sequences are required.
2. The available bandwidth is 3000 cps, with each signal filter assumed to be 100 cps, e.g., thirty "slots" of 100 cps each.
3. Each tone must be sent for a minimum of two seconds continuously.
4. The minimum spacing of two seconds must be maintained between tones.
5. The maximum message length is 60 seconds.

For the purpose of this analysis, it will be assumed that the following parameters are known to the unauthorized person who is attempting to "unlock" the actuation code:

1. The bandwidth of interest.
2. The requirement for three separate frequencies.
3. The signal bandwidth for each tone.
4. The minimum spacing required between tones.

Thus in order to generate a correct actuation code, the steps to be taken by the unauthorized transmitter are shown in FIG. 2, wherein it may be seen that the required message tones can be found anywhere within the range of 30 frequencies and 56 time "slots" are available for use in between tones. First, the three correct frequencies must be selected; Second, the frequencies must be in correct order; and Third, the correct time slots must be inserted before the second and third tones.

As shown, if any of the message components are not correct, the logic system will recognize this fact and will inhibit for 60 seconds, for this example. Thus in this case, the probability of successfully generating the correct message in one independent trial is given by the combination of successfully completing each step as shown below.

$$P(S_{trial}=P(S_1)\times P(S_2)\times P(S_3)$$

where $$P(S_1) = \frac{1}{30} \times \frac{1}{29} \times \frac{1}{28}$$

$$P(S_2) = \frac{1}{3'} = \frac{1}{6}$$

$$P(S_3) = \frac{2}{56} \times \frac{2}{56}$$

$$\therefore P(S_{trial}) = \frac{1}{24{,}400} \times \frac{1}{6} \times \frac{4}{3140} = \frac{4}{4.58 \times 10^8}$$

$$P(S_{trial}) \approx 8.7 \times 10^{-9}$$

The number of independent trials required to transmit every possible message combination is given by:

$$P(S_{total})=1-[(1-P(S_{trial})]^N$$

where

N=number of independent trials $P(S_{total})$=probability of generating the correct message in N trials=1, and for $P(S_{trial})<<<1$, the series can be approximated by $1-NP(S_{trial})$ thus $$N \approx \frac{P(S_{total})}{P_{S(trial)}} \approx \frac{1}{8.7 \times 10^{-9}} \approx \frac{1.15 \times 10^8 \text{ trials}}{}$$

Conclusion

From the foregoing it will be apparent that a remote actuating device has been provided which may be reliably placed in operation by a properly coded signal while preventing unauthorized operation by random signalling, active jamming, or the like and which may be manufactured in quantity at low cost.

While the invention has been particularly described in terms of conventional logical "building blocks" such as gates, flip-flops and delay multivibrators, it should not be construed as being limited thereto. Since the invention lends itself to numerous modifications departing from the above specification but remaining within the true scope of the disclosure, the invention is to be limited only by the appended claims.

What is claimed is:

1. A decoding logic receiver for an electronic control device comprising:

first circuit means, responsive to a correct sequence of transmitted tones of selected frequencies, for producing an output pulse;

second circuit means, responsive to either receipt of two or more simultaneously transmitted tones or receipt of tones transmitted in incorrect sequence, to provide a primary inhibit output pulse;

third circuit means, responsive to the absence of a signal during selected time intervals, for producing a secondary inhibit output pulse;

actuating means, responsive to receipt of an output pulse from said first circuit means, for producing an actuation output; and means responsive to either a primary inhibit output pulse or a secondary inhibit output pulse for preventing operation of said actuating means.

2. A decoding logic receiver according to claim 1 wherein the first circuit means is responsive only to receipt of a series of three specifically spaced signals transmitted at three distinctive frequencies.

3. A decoding logic receiver according to claim 2 wherein said first circuit means comprises:

(a) sensing means susceptible to signals on a plurality of distinctive frequencies;

(b) amplifier means connected to said sensing means for amplifying signals received by said sensing means;

band pass filter means comprising a plurality of devices for respectively passing only selected ones of said plurality of distinctive frequencies;

demodulating means comprising a detector connected to each of said devices of said filter means; and (e) logic means comprising means connected to said demodulating means for recognition of proper signals in correct time spaces and for issuing an output pulse only when the proper signals are received in the correct time sequence.

* * * * *